US008005382B2

(12) United States Patent
Tanaka

(10) Patent No.: US 8,005,382 B2
(45) Date of Patent: Aug. 23, 2011

(54) LIQUID DEVELOPER COLLECTING SYSTEM AND IMAGE FORMING APPARATUS INCLUDING THE SAME

(75) Inventor: Hiroshi Tanaka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 371 days.

(21) Appl. No.: 12/257,227

(22) Filed: Oct. 23, 2008

(65) Prior Publication Data

US 2009/0110423 A1 Apr. 30, 2009

(30) Foreign Application Priority Data

Oct. 25, 2007 (JP) ..... 2007-277541
May 19, 2008 (JP) ..... 2008-130607

(51) Int. Cl.
*G03G 15/10* (2006.01)

(52) U.S. Cl. ..... 399/57; 399/58; 399/233; 399/237; 399/238; 399/249

(58) Field of Classification Search ..... 399/57–58, 399/233, 237–238, 249
See application file for complete search history.

(56) References Cited

U.S. PATENT DOCUMENTS 5,574,548 A * 11/1996 Iino et al. ..... 399/240
6,229,971 B1 * 5/2001 Yamamoto ..... 399/58
6,687,477 B2 2/2004 Ichida et al.
2003/0175049 A1 9/2003 Ichida et al.
2007/0160391 A1 * 7/2007 Takano et al. ..... 399/237

FOREIGN PATENT DOCUMENTS

JP 2002-006637 1/2002
JP 2005242218 A * 9/2005

OTHER PUBLICATIONS

JP 2005242218 A english translation to Ueda et al.*

* cited by examiner

*Primary Examiner* — Ryan Walsh
(74) *Attorney, Agent, or Firm* — DLA Piper LLP (US)

(57) ABSTRACT

A liquid developer collecting system includes a developing roller cleaning unit that collects liquid developer on a developing roller; a developer storage unit that stores the liquid developer collected by the developing roller cleaning unit; and a concentration control unit that stores the liquid developer fed from the developer storage unit and controls the concentration of the liquid developer.

12 Claims, 8 Drawing Sheets

LIQUID DEVELOPER COLLECTING SYSTEM AND IMAGE FORMING APPARATUS INCLUDING THE SAME

CROSS-REFERENCE TO RELATED APPLICATIONS

This application claims the benefit of priority under 35 USC 119 of Japanese patent application no. 2007-277541, filed on Oct. 25, 2007, and Japanese patent application no. 2008-130607, filed on May 19, 2008, which are incorporated herein by reference.

BACKGROUND

1. Technical Field

The present invention relates to a plurality of photosensitive bodies, a plurality of developing devices that use liquid developer containing non-volatile solvent as carrier to develop electrostatic latent images formed on the respective photosensitive bodies, a transfer body that sequentially transfers toner images developed by transfer units corresponding to the plural photosensitive bodies and stacks the toner images, a liquid developer collecting system that controls concentration of liquid developer collected from the developing devices and reuses the liquid developer, and also relates to an image forming apparatus including these components.

2. Related Art

Various types of wet-type image forming apparatus that develop a latent image using high-viscosity liquid developer containing toner formed by solid components and dispersed in liquid solvent to visualize an electrostatic latent image have been proposed. The liquid developer used in a typical wet-type image forming apparatus contains solid components (toner particles) suspended in electricity-insulation organic solvent (carrier) such as silicon oil, mineral oil and edible oil. The particle diameter of the toner particles may be as small as about 1 μm. By using such fine toner particles, the wet-type image forming apparatus can produce higher quality images than those produced by a dry-type image forming apparatus, which uses powder toner particles typically having particle diameters of about 7 μm.

An image forming apparatus of the type using liquid developer has been proposed in which liquid developer collected from the developing device or photosensitive body is reused. According to one such image forming apparatus in the related art, a thin layer of liquid developer having a thickness of 1 to 50 μm is applied to a developing roller, and sent to a developing nip. Liquid developer that has passed the developing nip and remains on the developing roller is scraped by a blade and stored in a collection section. Then, solid particles of the collected liquid developer are shifted onto the photosensitive body, where the liquid developer is diluted. The carrier rate of liquid developer collected from the photosensitive body is high, and thus its solid concentration is lower than that of liquid developer collected from the developing device.

The diluted liquid developer is sent to a concentration control unit by using a pump or the like. Then, the diluted developer is mixed with high-concentration liquid toner supplied thereto to adjust the concentration of the developer to a target solid concentration. The liquid developer having the target solid concentration is again sent to the developing device and reused (see JP-A-2002-6637).

However, the proportion of the solid particles in the collected liquid developer is not constant. Typically, the consumption amount of the solid particles varies according to image data. For example, when the image data corresponds to full-tone, many solid particles contained in the liquid developer collected from the developing roller after development by using a developing roller cleaning blade are shifted to the photosensitive body and consumed. Thus, the collected liquid developer has a lower solid concentration. When the image data corresponds to half-tone, a small amount of the solid particles are shifted to the photosensitive body, and the solid concentration of the collected liquid developer thus changes little. Thus, the solid concentration needs to be adjusted to a target concentration by using a concentration control device when the solid concentration is equal to or lower than an allowable predetermined value in case of reuse of the collected liquid developer whose solid concentration varies. According to a color image forming apparatus, the concentration control device is provided for each color to prevent color mixture. In order to meet demand for size reduction of the image forming apparatus, the capacity of the concentration control device provided for each color needs to be reduced.

In order to adjust a low concentration of a collected liquid developer to a predetermined concentration using a concentration control device having a small capacity, a high-concentration new toner is supplied to the concentration control device from a toner tank. The concentration of the new toner may be, for example, about 35%. Thus, for example, when the concentration of the collected liquid developer is 17% under the condition of a predetermined concentration set at 20%, a predetermined amount of the new toner having the concentration of 35% needs to be supplied to adjust to the predetermined concentration by the concentration control device. In this case, the concentration cannot be efficiently adjusted when the concentration control device does not have sufficient vacant capacity.

SUMMARY

It is an advantage of some aspects of the invention to provide a liquid developer collecting system having a simple structure and that efficiently controls the concentration of collected liquid developer, and an image forming apparatus including this collecting system.

A liquid developer collecting system according to a first aspect of the invention includes: a developing roller cleaning unit that collects liquid developer on a developing roller; a developer storage unit that stores the liquid developer collected by the developing roller cleaning unit; and a concentration control unit that stores the liquid developer fed from the developer storage unit and controls the concentration of the liquid developer. According to this structure, the collected liquid developer is temporarily stored in the developer storage unit, and then fed to the concentration control unit. Thus, this structure can cope with variations in the solid concentration of the collected liquid developer, and efficiently control the concentration of the collected liquid developer.

The liquid developer collecting system may further include a liquid disposal tank and a distribution unit that distributes the liquid developer in the developer storage unit between the concentration control unit and the liquid disposal tank. According to this structure, it is possible to cope with variations in the solid concentration of the collected liquid developer, and efficiently control the concentration of the collected liquid developer.

The liquid developer collecting system may further include a collected liquid concentration estimating unit that estimates the concentration of the liquid developer collected by the developing roller cleaning unit using a dot count obtained from image data; and a control unit that controls the distribution unit based on the data obtained from the collected liquid concentration estimating unit. According to this structure, the toner amount to be consumed in the steps of image formation is estimated, and the solid concentration of the liquid developer collected from the developing roller is also estimated. Thus, real-time distribution of the collected liquid developer can be achieved in concentration control.

The liquid developer collecting system may further include a developing unit that has the developing roller; a liquid level sensor disposed in the concentration control unit; a concentration sensor disposed in the concentration control unit; and a feed unit that feeds liquid developer from the concentration control unit to the developing unit. According to this structure, the collected liquid developer can be reused after concentration control.

The liquid developer collecting system may further include a toner tank that stores liquid developer; a carrier tank that stores liquid carrier; a liquid developer supply unit that supplies liquid developer from the toner tank to the concentration control unit; and a liquid carrier supply unit that supplies liquid carrier from the carrier tank to the concentration control unit. According to this structure, it is possible to cope with variations in the solid concentration of the collected liquid developer, and efficiently control concentration of the collected liquid developer.

The liquid developer collecting system may further include a feeder that feeds the liquid developer collected from a photosensitive body by a squeeze roller to the concentration control unit. According to this structure, liquid developer having a high proportion of carrier on the photosensitive body can be reused without loss.

The liquid developer collecting system may further include a partition wall provided on the developing unit; a storage section sectioned by the partition wall and supplying liquid developer to the developing roller; and a storage section into which the liquid developer collected by the developing roller cleaning unit flows. In this case, liquid developer overflowing the partition wall from the storage section may flow into the collection section. According to this structure, the amount of liquid developer supplied to the storage section is set slightly larger than the liquid developer consumption amount required for development. Thus, no loss of developer is produced by collecting and reusing the overflowed liquid developer.

An image forming apparatus according to a second aspect of the invention includes: a photosensitive body on which an electrostatic latent image is formed; a developing unit that develops the electrostatic latent image by liquid developer to form an image; a transfer unit that transfers the image on the photosensitive body; a developing roller cleaning unit that collects liquid developer on a developing roller; a developer storage unit that stores the liquid developer collected by the developing roller cleaning unit; and a concentration control unit that stores the liquid developer fed from the developer storage unit and controls the concentration of the liquid developer. According to this structure, an image forming apparatus capable of reusing collected liquid developer with high efficiency is provided.

The image forming apparatus may further include a liquid disposal tank and a distribution unit that distributes the liquid developer in the developer storage unit between the concentration control unit and the liquid disposal tank. According to this structure, it is possible to cope with variations in the solid concentration of the collected liquid developer, and efficiently control concentration of the collected liquid developer.

The image forming apparatus may further include a collected liquid concentration estimating unit that estimates the concentration of the liquid developer collected by the developing roller cleaning unit using a dot count obtained from the image data; and a control unit that controls the distribution unit based on the data obtained from the collected liquid concentration estimating unit. According to this structure, the toner amount to be consumed in the steps of image formation is estimated, and the solid concentration of the liquid developer collected from the developing roller is also estimated. Thus, real-time distribution of the collected liquid developer is achieved in concentration control.

The image forming apparatus may further include a liquid level sensor disposed in the concentration control unit; a concentration sensor disposed in the concentration control unit; and a feed unit that feeds liquid developer from the concentration control unit to the developing unit. According to this structure, the collected liquid developer can be reused after concentration control.

The image forming apparatus may further include: a toner tank that stores liquid developer; a carrier tank that stores liquid carrier; a liquid developer supply unit that supplies liquid developer from the toner tank to the concentration control unit; and a liquid carrier supply unit that supplies liquid carrier from the carrier tank to the concentration control unit. According to this structure, it is possible to cope with variations in the solid concentration of the collected liquid developer, and efficiently control concentration of the collected liquid developer.

The image forming apparatus may further include: a squeeze roller provided on the photosensitive body; and a feeder that feeds the liquid developer collected by the squeeze roller to the concentration control unit. According to this structure, a liquid developer having a high proportion of carrier on the photosensitive body can be reused without loss.

The image forming apparatus may further include: a partition wall provided on the developing unit; a storage section sectioned by the partition wall and supplying liquid developer to the developing roller; and a storage section into which the liquid developer collected by the developing roller cleaning unit flows. In this case, liquid developer overflowing the partition wall from the storage section may flow into the collection section. According to this structure, the amount of the liquid developer supplied to the storage section is set slightly larger than the liquid developer consumption amount required for development. Thus, no loss of developer is produced by collecting and reusing the overflowed liquid developer.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
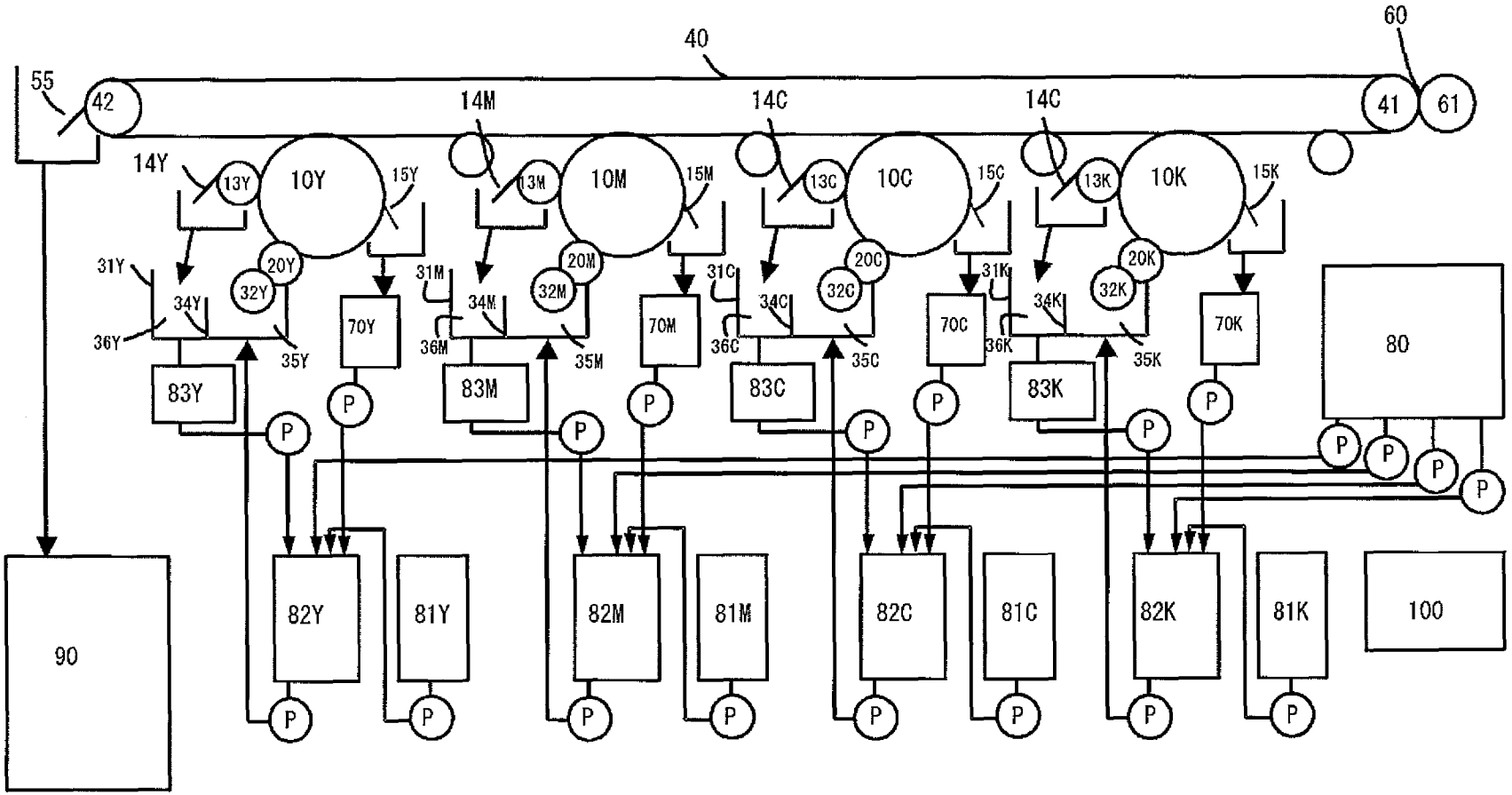
FIG. 1 illustrates an image forming apparatus that includes a liquid developer collecting system according to a first embodiment of the invention.
Figure 2:
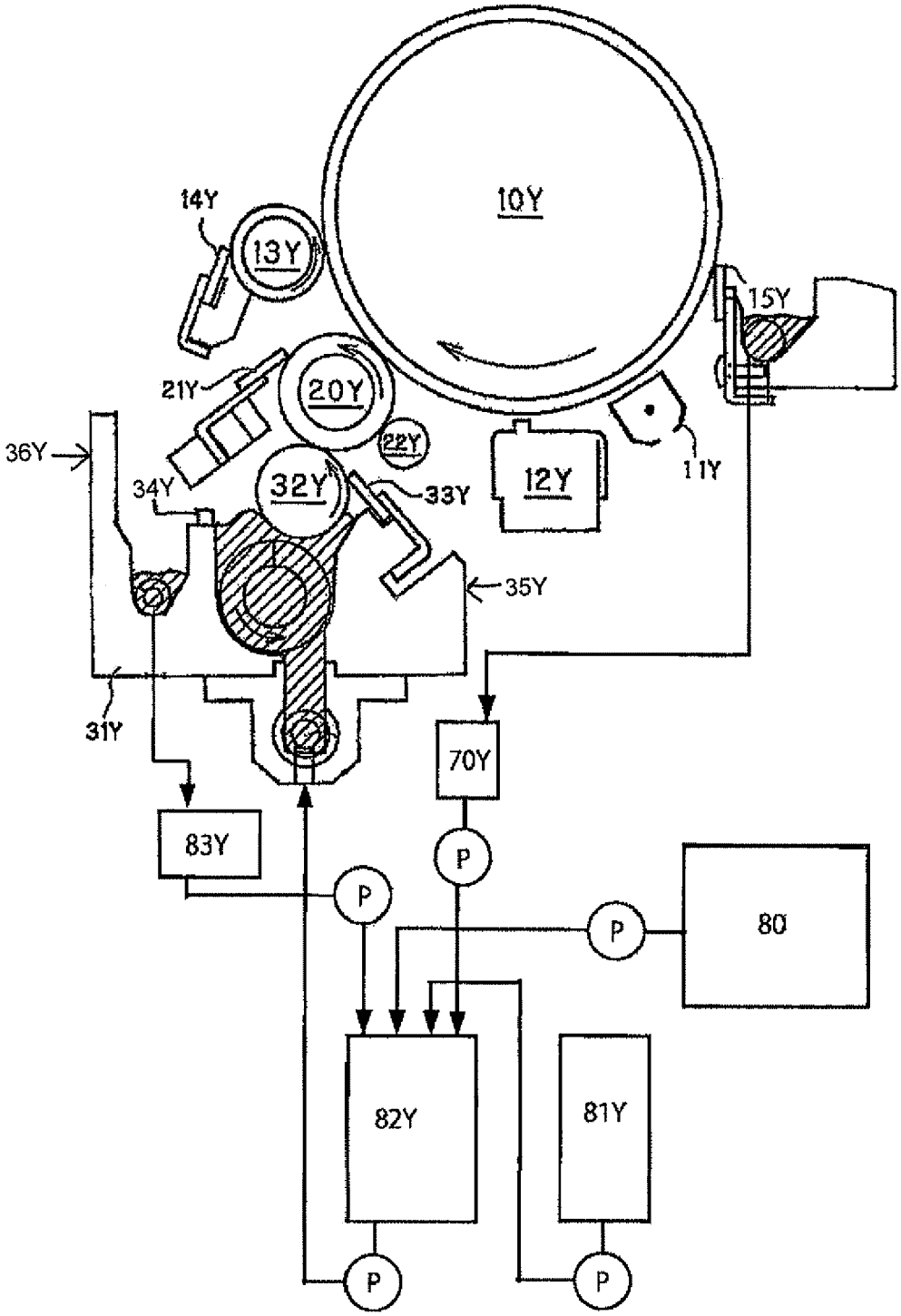
FIG. 2 is an enlarged view of a portion of the image forming apparatus of the first embodiment.

Embodiments of the invention are now described with reference to the drawings. FIG. 1 illustrates the main structure elements of an image forming apparatus 1 that includes a liquid developer collecting system according to a first embodiment of the invention. In FIG. 1, Y, M, C and K representing yellow (Y), magenta (M), cyan (C) and black (K) are added to each reference number given to the same structure element. FIG. 2 is an enlarged view of a portion of the image forming apparatus 1 of FIG. 1, showing the structure of an image forming section, a developing unit, an intermediate transfer body, and the liquid developer collecting system for yellow (Y).

As illustrated in FIG. 1, image forming apparatus 1 in this embodiment includes photosensitive bodies 10Y, 10M, 10C and 10K as latent image carrier bodies for yellow (Y), magenta (M), cyan (C) and black (K) disposed in tandem. The photosensitive bodies 10Y, 10M, 10C and 10K represent a yellow photosensitive body, a magenta photosensitive body, a cyan photosensitive body and a black photosensitive body, respectively. Each photosensitive body is constituted by a photosensitive body drum and may have an endless belt shape.

As can be seen from FIG. 2, the image forming section includes a corona electrifier 11Y, an exposure unit 12Y, a developing roller 20Y, a photosensitive squeeze roller 13Y, and a photosensitive body cleaning blade 15Y in the rotation direction (shift direction) of the outer circumference of the photosensitive body 10Y. The photosensitive body squeeze roller 13Y faces and contacts the photosensitive body 11Y between a developing roller 20Y and a primary transfer unit. The photosensitive squeeze roller 13Y has a squeeze roller cleaning blade 14Y that slidingly contacts and presses the surface of the photosensitive squeeze roller 13Y.

A developing roller cleaning blade 21Y disposed downstream from a developing nip contacts the outer circumference of the developing roller 20Y, and a developer supply roller 32Y using an anilox roller disposed upstream from the developing nip contacts the outer circumference of the developing roller 20Y. A regulating blade 33Y for regulating the developer supply amount contacts the developer supply roller 32Y. A corona electrifier 22Y for electrifying toner is disposed between the developing nip and the developer supply roller 32Y. The developer supply roller 32Y is contained in a developer container (toner reservoir) 31Y. A primary transfer roller (not shown) of a primary transfer unit 50Y is disposed at a position opposed to the photosensitive body 10Y with an intermediate transfer body 40 interposed between the primary transfer roller and the photosensitive body 10Y. An intermediate transfer body cleaning blade 55 is disposed on the intermediate transfer body 40.

Toner of the liquid developer contained in the developer container 31Y may include particles having an average particle diameter of 1 μm, for example, with colorant such as known pigment dispersed in known thermoplastic resin used for toner. The liquid carrier may be an insulation liquid carrier such as Isopar (trademarked product of Exxon Co) in the case of a low-viscosity concentration liquid developer. On the other hand, the liquid carrier may be an organic solvent; silicon oil having a flash point of 210° C. or higher, such as phenylmethyl siloxane, dimethyl polysiloxane, and polydimetyl siloxane; mineral oil; aliphatic saturated hydrocarbon having a boiling point of 170° C. or higher and relatively low viscosity such as 3 mPa·s at 40° C. such as liquid paraffin; normal paraffin; vegetable oil; edible oil; higher fatty acid ester; or another insulation liquid carrier in the case of a high-viscosity concentration liquid developer. For forming liquid developers, toner particles are added to the liquid carrier with dispersant, and the toner solid concentration is set at about 20%.

In the image forming section and the developing unit, the photosensitive body 10Y is uniformly electrified by the corona electrifier 11Y, and an electrostatic latent image is formed on the electrified photosensitive body 10Y by applying a laser beam modulated according to an inputted image signal by using the exposure unit 12Y having an optical system such as a semiconductor laser, polygon mirror and F-θ lens.

Then, the electrostatic latent image formed on the photosensitive body 10Y is developed by supplying liquid developer to the developing roller 20Y from the developer container 31Y as one of the developer containers containing the liquid developers in the respective colors (yellow in this example) via the developer supply roller 32Y while regulating the supply developer amount by using the regulating blade 33Y. The photosensitive body squeeze roller 13Y contacts the photosensitive body 10Y on which the electrostatic latent image has been developed by the developing roller 20Y to remove excessive carrier. The squeeze roller cleaning blade 14Y contacts the photosensitive body squeeze roller 13Y to collect the liquid developer removed from the photosensitive body 10Y and feed the liquid developer to a liquid developer reuse unit to be described later. The photosensitive body squeeze roller 13Y is a conductive elastic roller having an elastic member such as conductive urethane rubber and a fluororesin surface layer on the surface of a metal core.

The intermediate transfer body 40 is an endless belt component wound around a driving roller 41 and a following roller 42, and is rotated by the driving roller 41 while contacting the photosensitive bodies 10Y, 10M, 10C and 10K in the primary transfer units. The primary transfer rollers (not shown) of the primary transfer units are opposed to the photosensitive bodies 10Y, 10M, 10C and 10K with the intermediate transfer body 40 interposed there between. The primary transfer units apply primary transfer bias to toner images in respective colors on the photosensitive bodies 10Y, 10M, 10C and 10K after development at the contact positions with the photosensitive bodies 10Y, 10M, 10C and 10K as transfer positions. Then, the primary transfer units sequentially transfer the toner images overlapped with one another on the intermediate transfer body 40 to form a full-color toner image. The photosensitive cleaning blade 15Y contacts the photosensitive body 10Y after primary transfer to scrape and collect the carrier remaining after the primary transfer. The collected carrier is temporarily stored in a yellow buffer tank 70Y, and then fed from the yellow buffer tank 70Y to a yellow concentration control tank 82Y.

A secondary transfer roller 61 of a secondary transfer unit 60 is disposed opposed to the belt driving roller 41 with the intermediate transfer body 40 interposed therebetween. In the secondary transfer unit 60, sheet material such as sheet, film and fabric is fed and supplied along a sheet material feed path L at the same timing when a full-color toner image after color stacking or a monochrome toner image formed on the intermediate transfer body 40 reaches the transfer position of the secondary transfer unit 60. Then, the monochrome or full-color toner image is secondarily transferred on the sheet material by applying secondary transfer bias. A fixing unit (not shown) is disposed before the sheet material feed path L to fix the monochrome or full-color toner image transferred on the sheet material to a recording medium (sheet material) by fusing, and final image formation on the sheet material thereby ends. The intermediate transfer body cleaning blade 55 contacts the intermediate transfer body 40 after secondary transfer to collect remaining liquid developer and feed the collected liquid developer to a disposal tank 90.

The liquid developer collected by the photosensitive squeeze roller 13Y disposed between the developing position on the photosensitive body 10Y corresponding to the developing roller 20Y and the primary transfer unit, and by the photosensitive cleaning blade 15Y disposed downstream from the primary transfer unit corresponding to the photosensitive body 10Y, is reused for each color.

The unit for reusing the collected liquid developer in yellow is now discussed as an example. The developer container 31Y containing the liquid developer is sectioned into a storage section 35Y and a collection section 36Y by a partition wall 34Y. The developer supply roller 32Y for supplying liquid developer to the developing roller 20Y is disposed in the storage section 35Y. The developing roller cleaning blade 21Y contacts the outer circumference of the developing roller 20Y at a position downstream from the developing nip for the photosensitive body 10Y to scrape and collect the liquid developer from the developing roller 20Y after development and feed the collected liquid developer to the collection section 36Y.

The liquid developer removed by the photosensitive squeeze roller 13Y from the photosensitive body 10Y after development and prior to the primary transfer is scraped by the squeeze roller cleaning blade 14Y, and fed to the collection section 36Y of the developer container 31Y.

The liquid developer collected by the photosensitive body cleaning blade 15Y contacting the photosensitive body 11Y after the primary transfer is temporarily fed to the yellow buffer tank 70Y, and then sent from the yellow buffer tank 70Y to the yellow concentration control tank 82Y for reuse.

Components of the reuse unit are provided for each color. In case of yellow, for example, the reuse unit includes a yellow toner tank 81Y, a yellow concentration control tank 82Y, and a yellow storage tank 83Y. A common carrier tank 80 for all colors for storing new carrier is provided, and the concentration control tanks 82Y, 82M, 82C and 82K provided for each color are connected with the common carrier tank 80 via feed lines.

The collected liquid developer in the collection section 36Y of the developer container 31Y is initially fed to the yellow storage tank 83Y as a developer storage unit. The liquid developer temporarily stored in the yellow developer storage tank 83Y is further fed to the yellow concentration control tank 82Y as a concentration control unit via a pump. The liquid developer collected from the collection section 36Y of the developing unit and having variable concentration is temporarily stored in the yellow developer storage tank 83Y so that concentration control in the yellow concentration control tank 82Y having a small capacity can be efficiently performed.

A concentration sensor for measuring the concentration, a liquid level sensor for measuring the liquid level, and a stirring unit are disposed in the yellow concentration control tank 82Y. The concentration sensor may be of a light reflection type, a light transmission type, or other types. The liquid level sensor may be of a type containing a plurality of two-valued type hall devices disposed in the vertical direction in the concentration control tank and fixing a magnetic force generator to a buoyant body, or other types. The concentration and liquid level sensors contained in the yellow concentration control tank 82Y will be described later.

The yellow concentration control tank 82Y receives new toner having a concentration of about 35% from the yellow toner tank 81Y and new carrier from the common carrier tank 80 via the feed line. The yellow concentration control tank 82Y communicates with the storage section 35Y of the developer container 31Y by the feed line via a pump.

Figure 3:
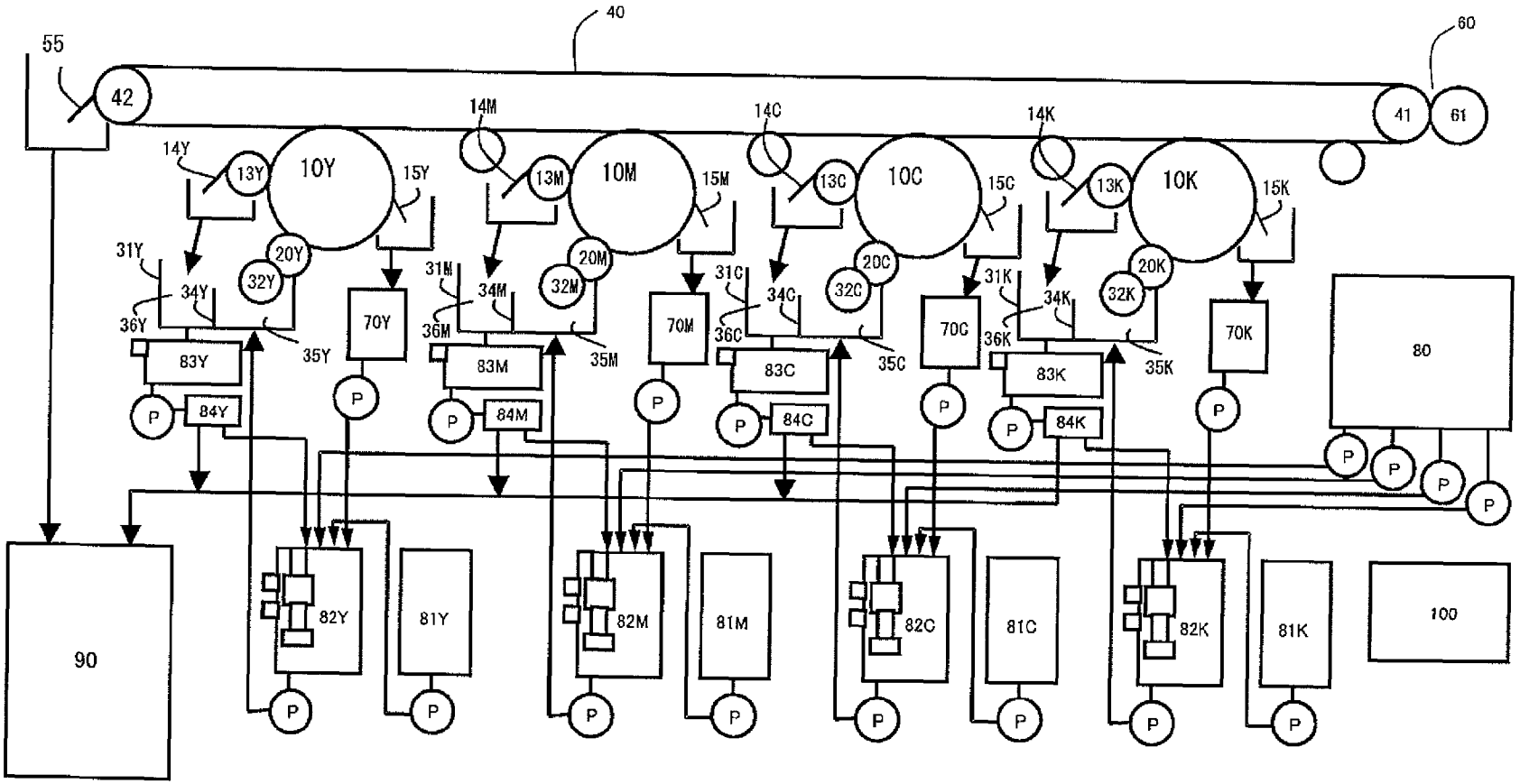
FIG. 3 illustrates an image forming apparatus including a liquid developer collecting system according to a second embodiment of the invention.
Figure 4:
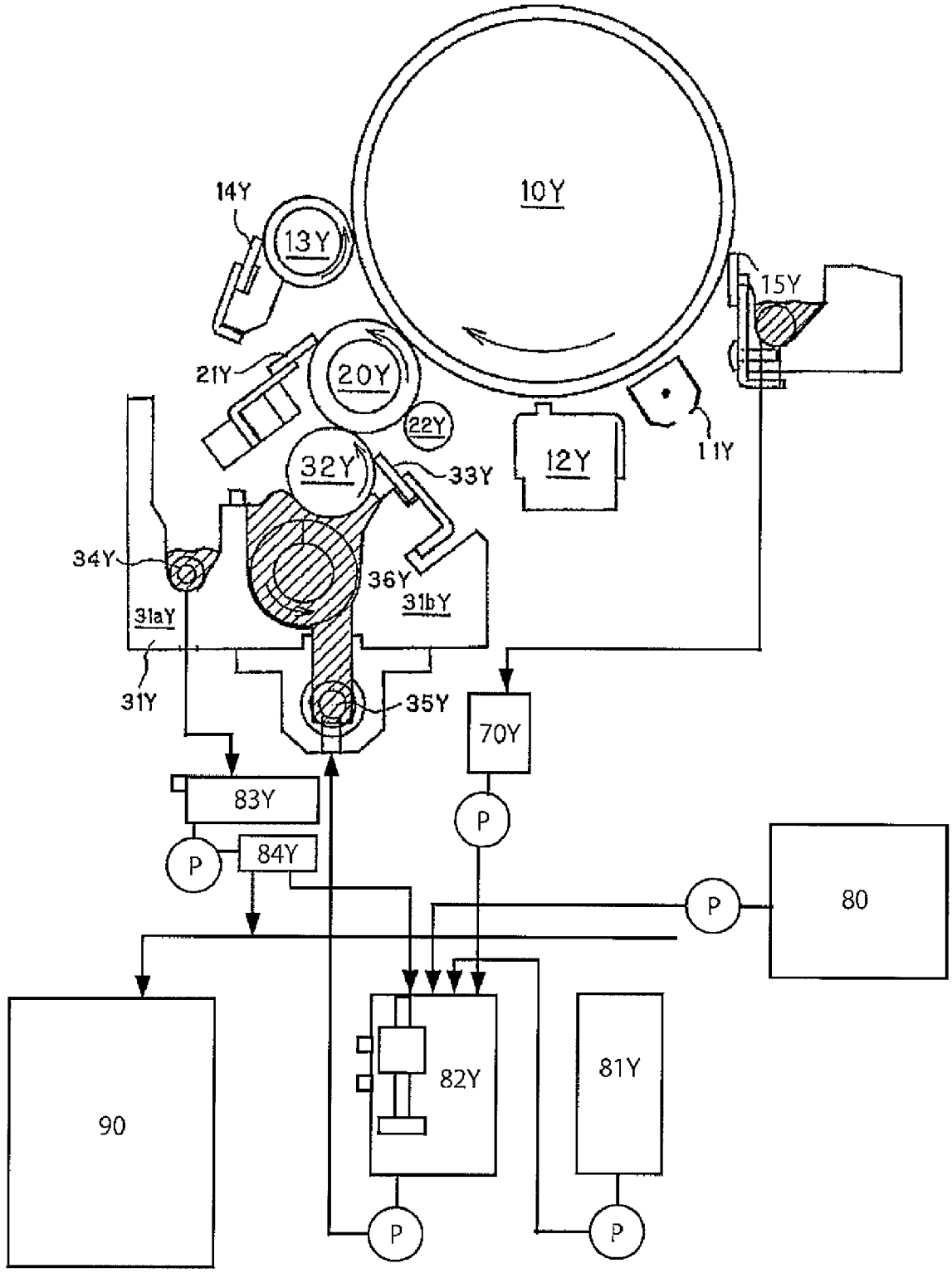
FIG. 4 is an enlarged view of a portion of the image forming apparatus of the second embodiment.

FIG. 3 illustrates the main structure elements of an image forming apparatus including a liquid developer collecting system according to a second embodiment of the invention. In FIG. 3, Y, M, C and K representing yellow (Y), magenta (M), cyan (C), and black (K) are added to each reference number given to the same structure element. FIG. 4 is an enlarged view of a portion of the image forming apparatus of FIG. 3, showing the image forming section, the developing unit, the intermediate transfer body, and the liquid developer collecting system for yellow (Y).

According to the second embodiment, liquid developer collected from the collection section 36Y of the developing unit is temporarily stored in the yellow developer storage tank 83Y, and distributed between the yellow developer concentration control tank 82Y and the disposal tank 90 by using a distribution unit 84Y. The sequence of processes performed by the distribution unit 84Y is described later. Other structure is similar to that of the liquid developer collecting system in the first embodiment, and the explanation of such structure is not repeated.

Figure 5:
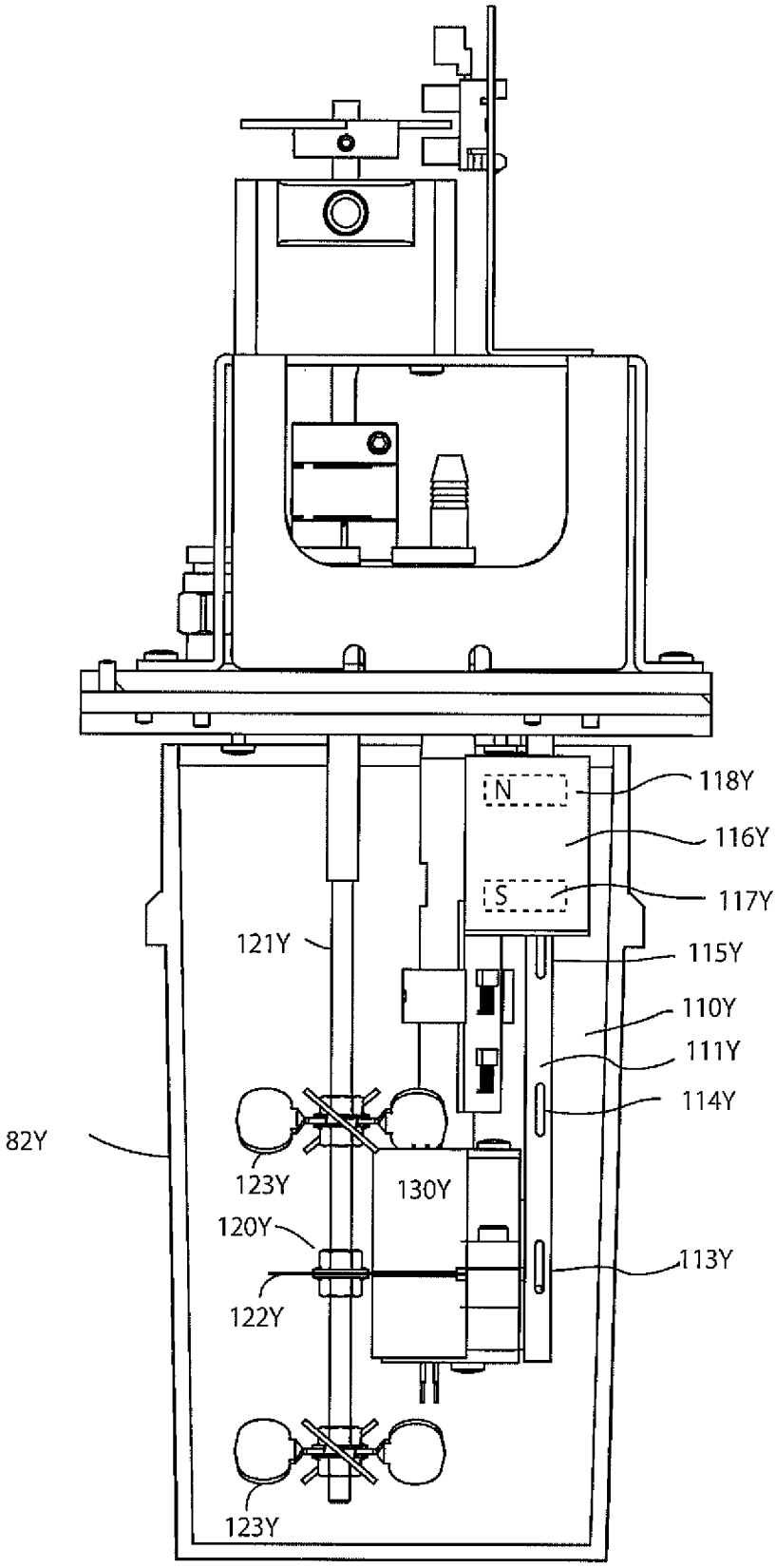
FIG. 5 illustrates a concentration control tank according to the invention.

The concentration and liquid level of the liquid developer are measured by the concentration and liquid level sensors disposed in the concentration control tank 82Y. A liquid amount measuring device 110Y as a liquid level sensor is first discussed. As illustrated in FIG. 5, the liquid amount measuring device 110Y has a float support member 111Y, a first hall device 113Y as an example of a proportional output type hall device 113Y, a second hall device 114Y, a third hall device 115Y, a float 116Y as an example of a float member, a first magnetic field generator 117Y, and a second magnetic field generator 118Y.

The float support member 111Y is constituted by a component supporting the float 116Y such that the float 116Y can shift from the surface of the liquid in the yellow concentration control tank 82Y approximately to the bottom below the liquid surface. The first hall device 113Y, the second hall device 114Y, and the third hall device 115Y are provided in this order from the lower position with a predetermined distance left between one another.

The first hall device 113Y, the second hall device 114Y, and the third hall device 115Y are constituted by proportional output type hall devices that vary output voltage relative to magnetic flux density. In this embodiment, each distance between the hall devices is set at 30 mm.

The float 116Y floats on the liquid surface and shifts with respect to the float support member 111Y according to the liquid surface position. The float 116Y has a first magnetic field generator 117Y at the lower position, and a second magnetic field generator 118Y at the upper position with a predetermined distance left therebetween. The first magnetic field generator 117Y and the second magnetic field generator 118Y shift such that these generators 117Y and 118Y come opposed to the respective hall devices 113Y, 114Y, and 115Y in accordance with the shift of the float 116Y. The first magnetic generator 117Y and the second magnetic generator 118Y are positioned such that the N pole and the S pole are located opposite for each magnetic generator. In this embodiment, each of the magnetic field generators 117Y and 118Y has a diameter of 5 mm and a length of 6 mm, and generates a 4,000 Gauss magnetic field, and the respective magnetic field generators 117Y and 118Y are disposed with a distance of 20 mm left between each other.

The concentration measuring device 120Y has a stirring propeller shaft 121Y, a transparent propeller 122Y as an example of a shift member, a stirring propeller 123Y as an example of a stirring member, and a concentration measuring unit 130Y. The stirring propeller shaft 121Y is a shaft on which the transparent propeller 122Y and the stirring propeller 123Y are coaxially provided, and rotated by a motor.

Figure 6:
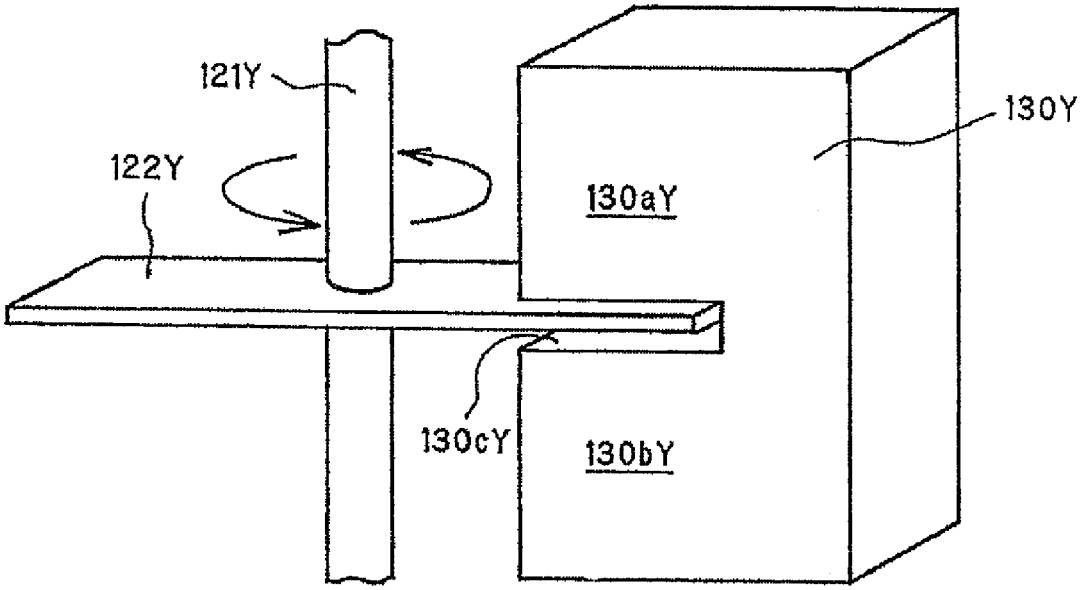
FIG. 6 illustrates a concentration measuring unit and a transparent propeller according to the invention.

A concentration detection method using the concentration measuring unit 130Y and the transparent propeller 122Y is now explained. As illustrated in FIG. 6, the transparent propeller 122Y is a rectangular or other flat-plate-shaped rotatable component that is supported by a stirring propeller shaft 121Y, and intermittently passes through a clearance 130*c*Y formed between a first member 130*a*Y and a second member 130*b*Y of the concentration measuring unit 130Y. The first member 130*a*Y and the second member 130*b*Y are movable to vary the length of the clearance 130*c*Y. The length of the clearance 130*c*Y can be varied according to the color of the liquid developer.

Figure 7A:
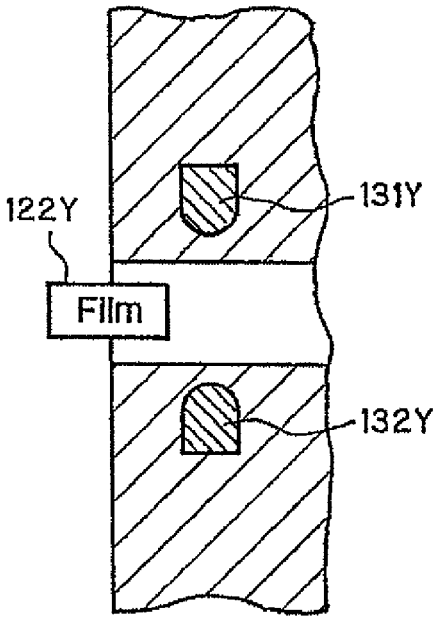
FIGS. 7A and 7B are cross sectional views of a transmission type concentration measuring unit according to the invention.
Figure 7B:
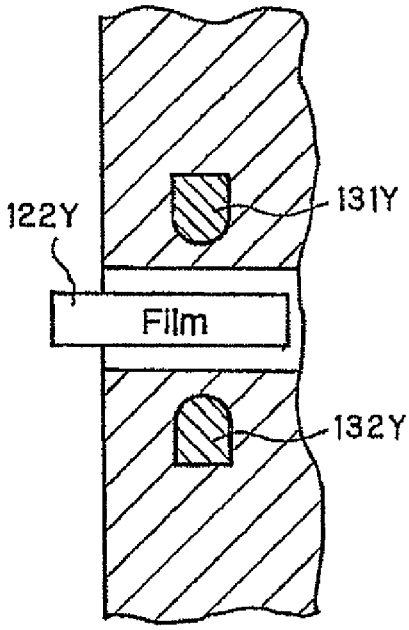

According to a transmission type concentration measuring unit 130Y as shown in FIGS. 7A and 7B, a light emission LED 131Y and a concentration measurement light receiving element 132Y as an example of a concentration measuring member are disposed opposed to each other with the clearance 130*c*Y interposed therebetween. An emission light intensity measurement light receiving element 133Y is disposed on the light emission LED 131Y side.

Figure 8:
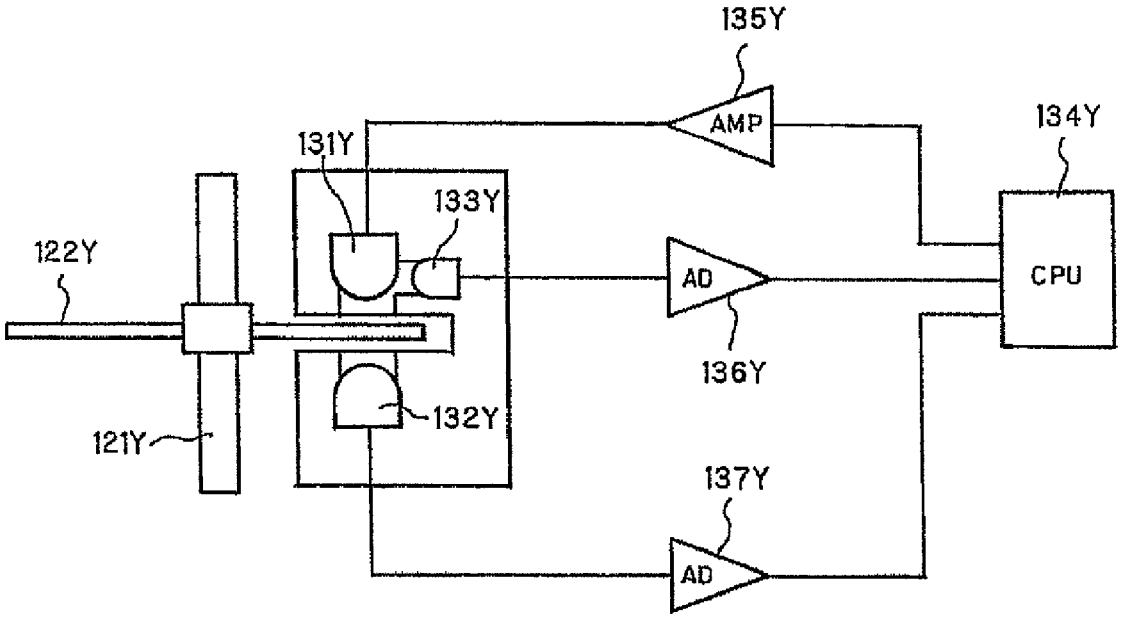
FIG. 8 is a circuit diagram illustrating a configuration of the transmission type concentration measuring unit according to the invention.

As illustrated in FIG. 8, the light emission LED 131Y, the concentration measurement light receiving element 132Y, and the emission light intensity measurement light receiving element 133Y are connected with a CPU 134Y. The light emission LED 131Y is connected with the CPU 134Y via an amplifier 135Y, the concentration measurement light receiving element 132Y is connected with the CPU 134Y via a first A/D converter 136Y, and the emission light intensity measurement light receiving element 133Y is connected with the CPU 134Y via a second A/D converter 137.

Figure 9:
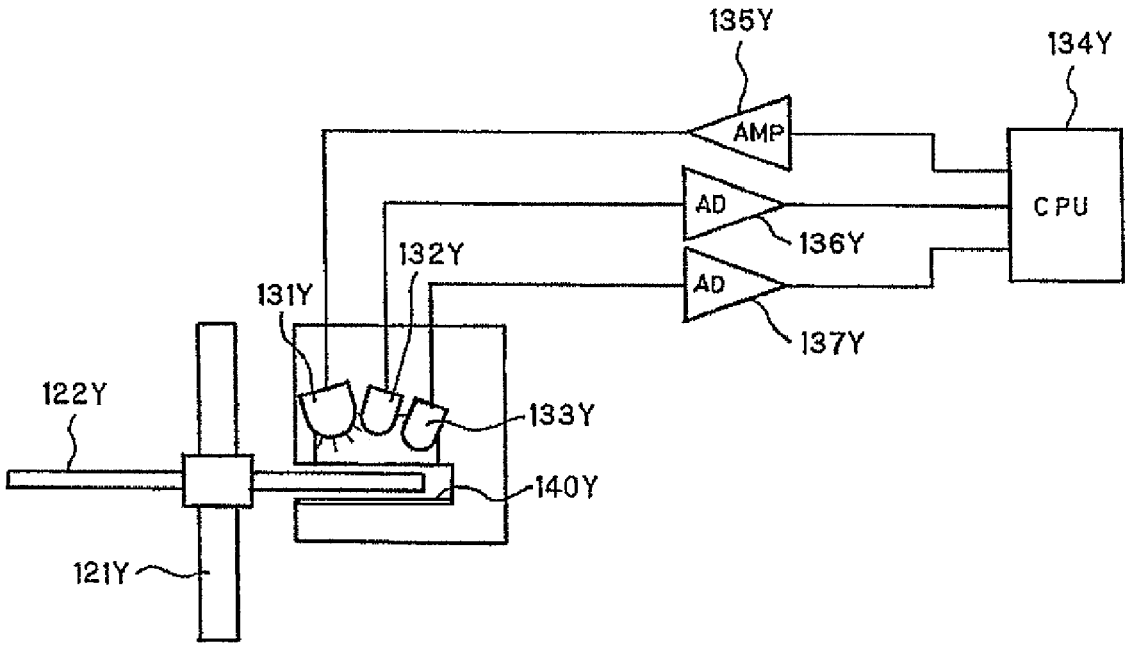
FIG. 9 is a circuit diagram illustrating a configuration of a reflective type concentration measuring unit according to the invention.

According to a reflection type concentration measuring unit 130Y as shown in FIG. 9, the light emission LED 131Y, the concentration measurement light receiving element 132Y, and the emission light intensity measurement light receiving element 133Y are disposed on one side of the clearance 130*c*Y. A reflection film 140Y is provided on the other side of the clearance 130*c*Y.

In this structure, light emitted from the light emission LED 131Y has an optical path that passes the liquid developer on the light emission LED 131Y side from the transparent propeller 122Y, the transparent propeller 122Y, and the liquid developer on the reflection film 140Y side. Then, the light is reflected by the reflection film 140Y, and passes the liquid developer on the reflection film 140Y side, the transparent propeller 122Y, and the liquid developer on the concentration measurement light receiving element 132Y side from the transparent propeller 122Y to be received by the concentration measurement light receiving element 132Y. The light emitted from the light emission LED 131Y also has an optical path that passes the liquid developer on the light emission LED 131Y from the transparent propeller 122Y to be received by the emission light intensity measurement light receiving element 133Y.

The light emission LED 131Y, the concentration measurement light receiving element 132Y, and the emission light intensity measurement light receiving element 133Y are connected with the CPU 134Y. The light emission LED 131Y is connected with the CPU 134Y via the amplifier 135Y, the concentration measurement light receiving element 132Y is connected with the CPU 134Y via the first A/D converter 136Y, and the emission light intensity measurement light receiving element 133Y is connected with the CPU 134Y via the second A/D converter 137Y.

The solid concentration of the liquid developer collected by the developing roller cleaning blade 21Y from the developing roller 20Y after development and fed to the collection section 36Y varies according to image data. More specifically, when the image data corresponds to full-tone, many solid particles are shifted to the photosensitive body and consumed. Thus, the solid concentration of the liquid developer is low. When the image data corresponds to half-tone, by contrast, only a small amount of solid particles are shifted to the photosensitive body. In this case, the solid concentration of the collected liquid developer changes little.

The liquid developer scraped by the squeeze roller cleaning blade 14Y from the photosensitive body squeeze roller 13Y that contacts the photosensitive body 10Y after development and prior to the primary transfer and removes the remaining liquid developer to be fed to the collection section 36Y has a large proportion of carrier and a low solid concentration.

The liquid developer collected by the photosensitive cleaning blade 15Y contacting the photosensitive body 10Y after primary transfer and temporarily fed to the yellow buffer tank 70Y has a large proportion of carrier and a low solid concentration.

The amount of the liquid developer supplied to the storage section 35Y of the developer container 31Y is set slightly larger than the liquid developer consumption amount required for development. Thus, the liquid developer supplied to the storage section 35Y overflows the partition wall 34Y toward the collection section 36Y. The concentration of the liquid developer overflowing from the storage section 35Y is adjusted to the target concentration, and thus the concentration does not change.

The amount of the liquid developer collected by the developing roller cleaning blade 21Y from the developing roller 20Y after development is the largest in the liquid developer flowing into the storage section 36Y of the developer container 31Y. Also, the solid concentration of this liquid developer varies the greatest. Thus, the solid concentration of the liquid developer collected from the developing roller 20Y influences the entire solid concentration of the collected liquid developer.

The capacity of the concentration control tank 82Y for adjusting the concentration of the collected liquid developer to the target concentration for reuse needs to be small since the concentration control tank is equipped for each color for prevention of color mixture. For example, when new toner having a solid concentration of 35% and contained in the toner tank 81Y is supplied and stirred to adjust a solid concentration of 17% of liquid developer collected and contained in the concentration control tank 82Y to a target solid concentration of 20%, the concentration control tank 82Y needs to have a remaining capacity for accommodating the additional new toner.

However, when the liquid developer collected from the storage section 36Y of the developing unit is directly fed to the concentration control tank 82Y and has a solid concentration that is lower than a predetermined value, a large amount of high-concentration new toner needs to be supplied to the concentration control tank 82Y to adjust to the target concentration in the concentration control tank 82Y. In this case, it is difficult to efficiently adjust the solid concentration when the capacity of the concentration control tank 82Y is limited.

According to the liquid development collecting system in this embodiment, therefore, the yellow liquid developer storage tank 83Y for temporarily storing the liquid developer collected from the storage section 36Y of the developing unit is provided. Since the developer storage tank 83Y is disposed upstream from the concentration control tank 82Y, the structure in this embodiment can cope with variations in the solid concentration of the collected liquid developer.

Moreover, for coping with variations in the solid concentration of the collected liquid developer, the collected liquid developer contained in the yellow developer storage tank 83Y that temporarily stores the collected liquid developer collected from the storage section 36Y of the developing unit is distributed between the yellow concentration control tank 82Y and the disposal tank 90 by using the distribution unit 84Y in the second embodiment.

The factor based on which the distribution by the distribution unit 84Y is controlled is the solid concentration of the collected liquid developer in the collection section 36Y. As discussed above, variation in the solid concentration in the collection section 36Y is considerably affected by variations in the solid concentration of the liquid developer collected by the developing roller cleaning blade 21Y from the developing roller 20Y after development. Since the variation in the solid concentration varies according to image data, the solid concentration of the collected liquid developer contained in the collection section 36Y can be estimated based on the image data by using a dot counter 100.

According to the image forming apparatus in this embodiment, printing dot data on the arrangement of the printing dots is produced by applying predetermined signals to image signals corresponding to image data. Then, an electrostatic latent image corresponding to the printing dots is formed on the photosensitive body 10Y, and made conspicuous by the liquid developer. Thus, the toner consumption amount can be estimated by counting the printing dot number based on the image data. The toner consumption amount may be estimated by dot counter 100 using a simple count technology that simply estimates the toner consumption amount separately for each dot of the respective image data without considering the continuity of dots, a one-dimensional count technology that estimates the toner consumption amount considering one-dimensional dot continuity, a two-dimensional count technology that estimates the toner consumption amount considering a two-dimensional arrangement of dots of the image data, and other technologies.

The distribution unit 84Y includes a first position that closes the feed line of the collected liquid developer from the developer storage unit 83Y, a second position for feeding the collected liquid developer to the concentration control tank 82Y, and an electromagnetic valve that can switch to a third position for feeding the collected liquid developer to the disposal tank 90. The electromagnetic valve constituting the distribution unit 84Y is controlled based on the data from the collected liquid developer concentration estimating unit using the dot counter 100. When the data from the dot counter 100 as the collected liquid developer concentration estimating unit is a predetermined value or higher, it is judged that the solid concentration of the collected liquid developer collected in the collection section 36Y is lower than a predetermined concentration.

Figure 10:
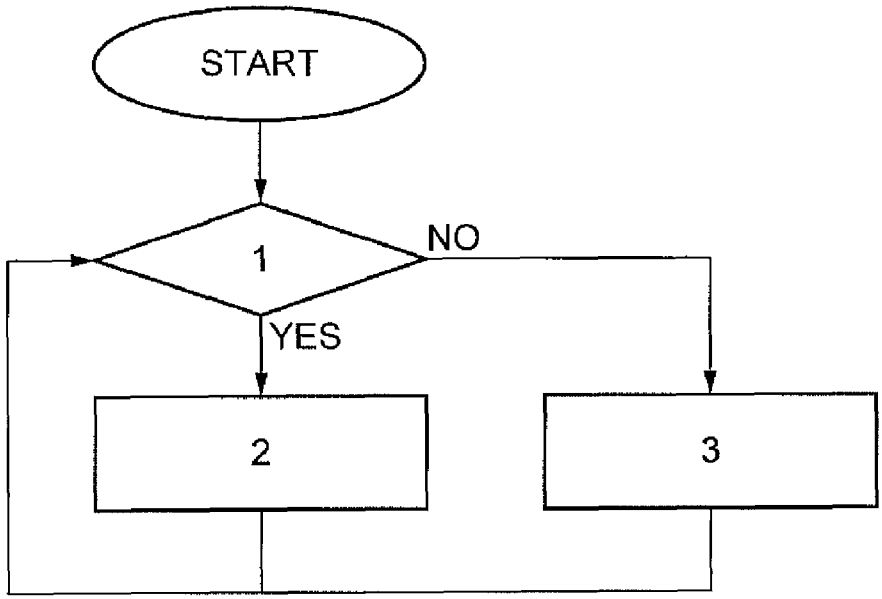
FIG. 10 is a flowchart of a sequence of processes performed by the liquid developer collecting system according to the invention.

FIG. 10 is a flowchart showing an example of a sequence of processes performed by the liquid developer collecting system according to this embodiment. The collected liquid developer concentration estimating unit using the dot counter 100 initially judges whether the solid concentration of the collected liquid developer in the developer storage unit 83Y is lower than a predetermined value (5%) in step (1). When it is judged that the solid concentration is lower than 5% in step (1) (YES), the process shifts to step (2). When it is judged that the solid concentration is 5% or higher (NO), the process goes to step (3).

In step (2), the collected liquid developer in the developer storage unit 83Y is fed alternately to the concentration control tank 82Y and the disposal tank 90 each for 5 seconds by the distribution unit 84Y. After 10 seconds, the process returns to step (1), and the collected liquid developer concentration estimating unit using the dot counter 100 judges whether the solid concentration of the collected liquid developer in the developer storage unit 83Y is lower than the predetermined value (5%).

In step (3), collected liquid developer that is to have a solid concentration that is 5% or higher is fed to the concentration control tank 82Y.

In step (2), driving of the pump for feeding the collected liquid developer in the developer storage unit 83Y is stopped for 5 seconds, and then the pump is driven for 5 seconds to feed the collected developer to the concentration control tank 82Y. Alternatively, the pump for feeding the collected liquid developer in the developer storage unit 83Y may be driven for 10 seconds at a liquid feed speed 50% lower than the normal feed speed. After 10 seconds, the process again returns to step (1), and the collected liquid developer concentration estimating unit using the dot counter 100 judges whether the solid concentration of the collected liquid developer in the developer storage unit 83Y is lower than the predetermined value (5%). In step (3), collected liquid developer judged to have a solid concentration that is 5% or higher is fed to the concentration control tank 82Y for 10 seconds at the normal liquid feed speed (100%).

Figure 11:
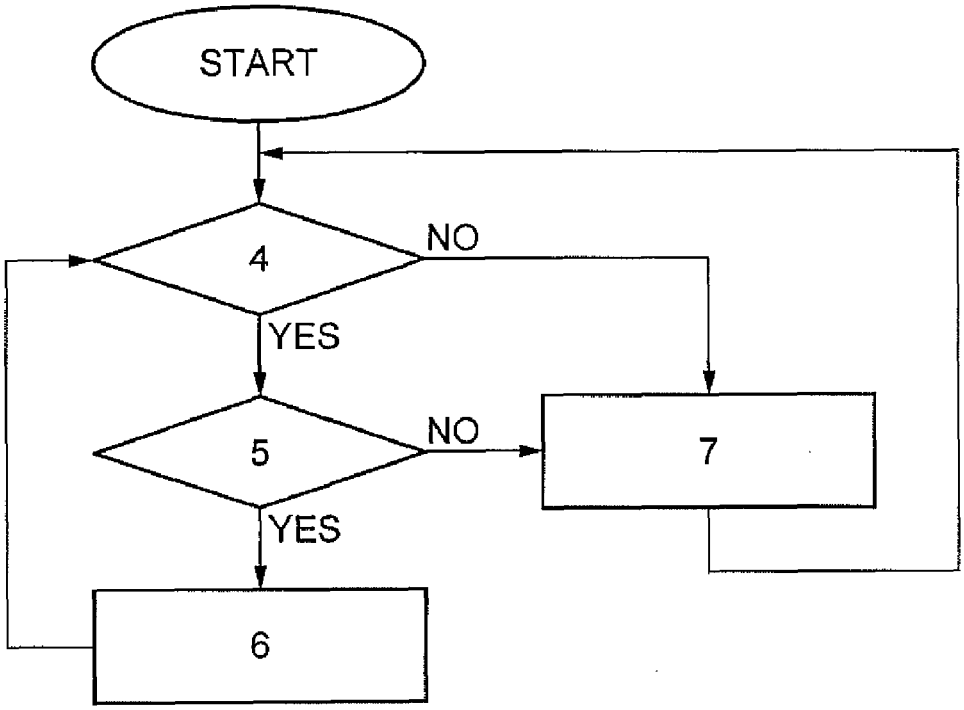
FIG. 11 is a flowchart of a sequence of processes performed by the liquid developer collecting system according to the invention.

In step (4) in the sequence shown in FIG. 11, the collected liquid developer concentration estimating unit using the dot counter 100 judges whether the solid concentration of the collected liquid developer in the developer storage unit 83Y is lower than the predetermined value (5%). When it is judged that the solid concentration is lower than 5% (YES) in step (4), the process shifts to step (5). When it is judged the solid concentration is 5% or higher (NO) in step (4), the process goes to step (7).

In step (5), it is judged whether the liquid level in the concentration control tank 82Y is a predetermined value (118 mm) or higher. When it is judged that the liquid level in the concentration control tank 82Y is the predetermined value (118 mm) or higher (YES) in step (5), the process shifts to step (6). When it is judged that the liquid level in the concentration control tank 82Y is lower than the predetermined value (118 mm) (NO) in step (5), the process goes to step (7).

When the liquid level in the concentration control tank 82Y is the predetermined value or higher and the full-capacity of the sensor or lower in step (5), the driving of the pump in the developer storage unit 83Y is stopped for 5 seconds. When the liquid level in the concentration control tank 82Y is the predetermined value or higher and the full-capacity of the sensor or higher, the pump of the developer liquid storage unit 83Y is driven for 5 seconds to feed the collected liquid developer to the disposal tank 90 via the distribution unit 84. After 5 seconds, the process returns to step (4), and the collected liquid developer concentration estimating unit using the dot counter 100 judges whether the solid concentration of the collected liquid developer in the developer storage unit 83Y is lower than the predetermined value (5%).

In step (7), the pump of the developer storage unit 83Y is driven for 5 seconds to feed to the collected liquid developer to the concentration control tank 82Y via the distribution unit 84Y. After 5 seconds, the process returns to step (4), and the collected liquid developer concentration estimating unit using the dot counter 100 judges whether the solid concentration of the collected liquid developer in the developer storage unit 83Y is lower than the predetermined value (5%).

Accordingly, the liquid developer collecting system in this embodiment controls concentration of collected liquid developer by a simple structure with high efficiency, and contributes to size reduction of the image forming apparatus by reducing space required for the devices.

What is claimed is:

1. A liquid developer collecting system, comprising:

a developing unit that develops an electrostatic latent image by liquid developer and including:

a developing roller that develops the electrostatic latent image, a storage section that stores the liquid developer and supplies the liquid developer to the developing roller, a developing roller cleaning unit that collects the liquid developer on the developing roller, a collection section into which the liquid developer collected by the developing roller cleaning unit flows and that stores the liquid developer collected by the developing roller cleaning unit, and a partition wall that partitions the storage section and the collection section and that is overflowed by the liquid developer from the storage section into the collection section;

a developer storage unit that stores the liquid developer fed from the collection section of the developing unit;

a concentration control unit that controls the concentration of the liquid developer fed from the developer storage unit;

a liquid disposal tank that stores waste liquid developer; and a distribution unit that distributes the liquid developer in the developer storage unit between the concentration control unit and the liquid disposal tank.

2. The liquid developer collecting system according to claim 1, further comprising:

a collected liquid concentration estimating unit that estimates the concentration of the liquid developer collected by the developing roller cleaning unit using a dot count obtained from image data; and a control unit that controls the distribution unit based on data obtained from the collected liquid concentration estimating unit.

3. The liquid developer collecting system according to claim 2, further comprising:

a liquid level sensor that measures a liquid level in the concentration control unit;

a concentration sensor that measures the concentration of the liquid developer in the concentration control unit; and a feed unit that feeds liquid developer from the concentration control unit to the storage section of the developing unit.

4. The liquid developer collecting system according to claim 3, further comprising:

a toner tank that stores liquid developer;

a carrier tank that stores liquid carrier;

a liquid developer supply unit that supplies liquid developer from the toner tank to the concentration control unit; and a liquid carrier supply unit that supplies liquid carrier from the carrier tank to the concentration control unit.

5. The liquid developer collecting system according to claim 1, further comprising a squeeze roller that squeezes a photosensitive body.

6. The liquid developer collecting system according to claim 1, wherein if the concentration falls below a predetermined value, then the distribution unit distributes the liquid developer to both the concentration control unit and the liquid disposal tank.

7. An image forming apparatus, comprising:

a photosensitive body on which an electrostatic latent image is formed;

a developing unit that develops the electrostatic latent image by liquid developer to form an image and including:

a developing roller that develops the electrostatic latent image, a storage section that stores the liquid developer and supplies the liquid developer to the developing roller, a developing roller cleaning unit that collects the liquid developer on the developing roller, a collection section into which the liquid developer collected by the developing roller cleaning unit flows and that stores the liquid developer collected by the developing roller cleaning unit, a partition wall that partitions the storage section and the collection section and that is overflowed by the liquid developer from the storage section into the collection section;

a transfer unit that transfers the image on the photosensitive body;

a developer storage unit that stores the liquid developer fed from the collection section of the developing unit;

a concentration control unit that controls the concentration of the liquid developer fed from the developer storage unit;

a liquid disposal tank that stores waste liquid developer; and a distribution unit that distributes the liquid developer in the developer storage unit between the concentration control unit and the liquid disposal tank.

8. The image forming apparatus according to claim 7, further comprising:

a collected liquid concentration estimating unit that estimates the concentration of the liquid developer collected by the developing roller cleaning unit using a dot count obtained from image data; and a control unit that controls the distribution unit based on data obtained from the collected liquid concentration estimating unit.

9. The image forming apparatus according to claim 8, further comprising:

a liquid level sensor that measures a liquid level in the concentration control unit;

a concentration sensor that measures the concentration of the liquid developer in the concentration control unit; and a feed unit that feeds liquid developer from the concentration control unit to the developing unit.

10. The image forming apparatus according to claim 9, further comprising:

a toner tank that stores liquid developer;

a carrier tank that stores liquid carrier;

a liquid developer supply unit that supplies liquid developer from the toner tank to the concentration control unit; and a liquid carrier supply unit that supplies liquid carrier from the carrier tank to the concentration control unit.

11. The image forming apparatus according to claim 7, further comprising:

a squeeze roller provided on the photosensitive body;

wherein the liquid developer collected by the squeeze roller is fed to the collection section of the developing unit.

12. The image forming apparatus according to claim 7, wherein if the concentration falls below a predetermined value, then the distribution unit distributes the liquid developer to both the concentration control unit and the liquid disposal tank.

* * * * *